US006182672B1

(12) United States Patent
Abasta-Douglas et al.

(10) Patent No.: US 6,182,672 B1
(45) Date of Patent: Feb. 6, 2001

(54) LOOPED FASTENER DECORATIVE HAIR TIE OR QIK TI HAIR CINCH

(76) Inventors: Feliz R. Abasta-Douglas; Christi L. Martinez, both of 1747 Henry Scott Rd., Ball Ground, GA (US) 30107

( * ) Notice: Under 35 U.S.C. 154(b), the term of this patent shall be extended for 0 days.

(21) Appl. No.: 09/493,590

(22) Filed: Jan. 31, 2000

Related U.S. Application Data

(60) Provisional application No. 60/118,241, filed on Feb. 2, 1999.

(51) Int. Cl.[7] ..... A45D 8/12; A45D 8/04

(52) U.S. Cl. ..... 132/275; 132/273

(58) Field of Search ..... 132/275, 273, 132/276, 277, 278; D28/41, 42, 43; 2/171, 141

(56) References Cited

U.S. PATENT DOCUMENTS 537,542 * 4/1895 Moore ..... 132/275
3,099,271 * 7/1963 Dubelier ..... 132/275
3,751,769 * 8/1973 Reiner ..... 132/273
4,406,296 * 9/1983 Wexler et al. ..... 132/148
5,167,245 * 12/1992 Harriett ..... 132/273
5,230,355 * 7/1993 Weingrod ..... 132/275
5,388,598 * 2/1995 Whitten ..... 132/275
5,778,904 * 7/1998 Elsner ..... 132/275
5,881,736 * 3/1999 Turner et al. ..... 132/200

* cited by examiner

*Primary Examiner*—John J. Wilson
*Assistant Examiner*—Robyn Kieu Doam
(74) *Attorney, Agent, or Firm*—Thomas C. Saitta

(57) ABSTRACT

A looped fastener having a fabric covered elasticized member having a thin, substantially rectangular cross-sectional configuration having terminal ends formed in a loop by passing the elasticized member through a hollow open ended decorative body. The looped fastener is tightened and loosened by moving the open ended body up and down the fabric covered elasticized member. The smaller the loop the tighter the fasten. The larger the loop the looser the fasten. Secondary open ended bodies affixed to the terminal ends of the fabric covered elasticized member prevent the elasticized member from accidentally being pulled out of the aforementioned open ended body.

10 Claims, 3 Drawing Sheets

LOOPED FASTENER DECORATIVE HAIR TIE OR QIK TI HAIR CINCH

This application claims the benefits of U.S. Provisional Application No. 60/118.241, filed Feb. 2,1999.

CROSS REFERENCE TO RELATED APPLICATIONS

Not Applicable.

STATEMENT REGARDING FEDERALLY FUNDED SPONSORED RESEARCH OR DEVELOPMENT

Not Applicable.

BACKGROUND OF THE INVENTION

This invention relates to an improved fastener for various purposes and particularly to fasteners for hair ties.

Presently, there are many different methods of securing hair. Ribbons, bands, strings, barrettes, fabric rings, wraps, clips, combs, hair pins, ropes and clasps are commonly used to assist in achieving certain hair styles. Prior art discloses hair ties which are either secured by wrapping string or the like around a closed loop or by using a locking device to close a loop. The prior art which uses a locking device is limited in its fabrication because it must be made of thin rope-like material in order to be able to pass through the locking device. These methods of hair styling assistance are satisfactory in their function. However, because of the modes applied in accomplishing a secure closed loop, these methods are limited in their design capabilities. The average person knows that the reason hair styles exist is because they are an expression of design.

The present invention accomplishes the desired effect of securing hair by utilizing an adjustable loop while also allowing the user the opportunity of expression of design which is more applicable to today's styles than the aforementioned prior art.

BRIEF SUMMARY OF INVENTION

The present invention is directed to an improved hair tie fastener which performs the function of securing varying amounts of hair while also offering diversity of design expression. It is an object of this present invention to hold varying amounts of hair in the location desired by the wearer. It is an object of this present invention to hold hair in place during exercise and other physical activities performed by the wearer. It is an object of this present invention to enable the wearer to choose between several fashionable designs in achieving a style best suited for the wearer. A looped fastener hair tie having features of the present invention comprises a predetermined length of a long narrow elasticized memberhaving a thin, substantially rectangular cross-sectional configuration,covered with fabric, which is passed through one or more decorative stop bodies having open ends forming a loop generally in the middle of the elasticized member. The fabric when fully extended is longer than the elasticized member in its unstretched condition, so that the fabric becomes gathered into a plurality of folds. The size of the loop of the present invention is regulated by moving the decorative stop bodies in one direction or another. Once the preferred loop size is accomplished the folds of fabric covering the elasticized member work in conjunction with the stop bodies in securing the hair by bunching at the open end of the stop bodies. The fabric covered elasticized member of the present invention comprises terminal ends which may be tied or decorated with additional stop bodies for the purpose of keeping the primary stop bodies intact.

DESCRIPTION OF THE PREFERRED EMBODIMENTS

Figure 1:
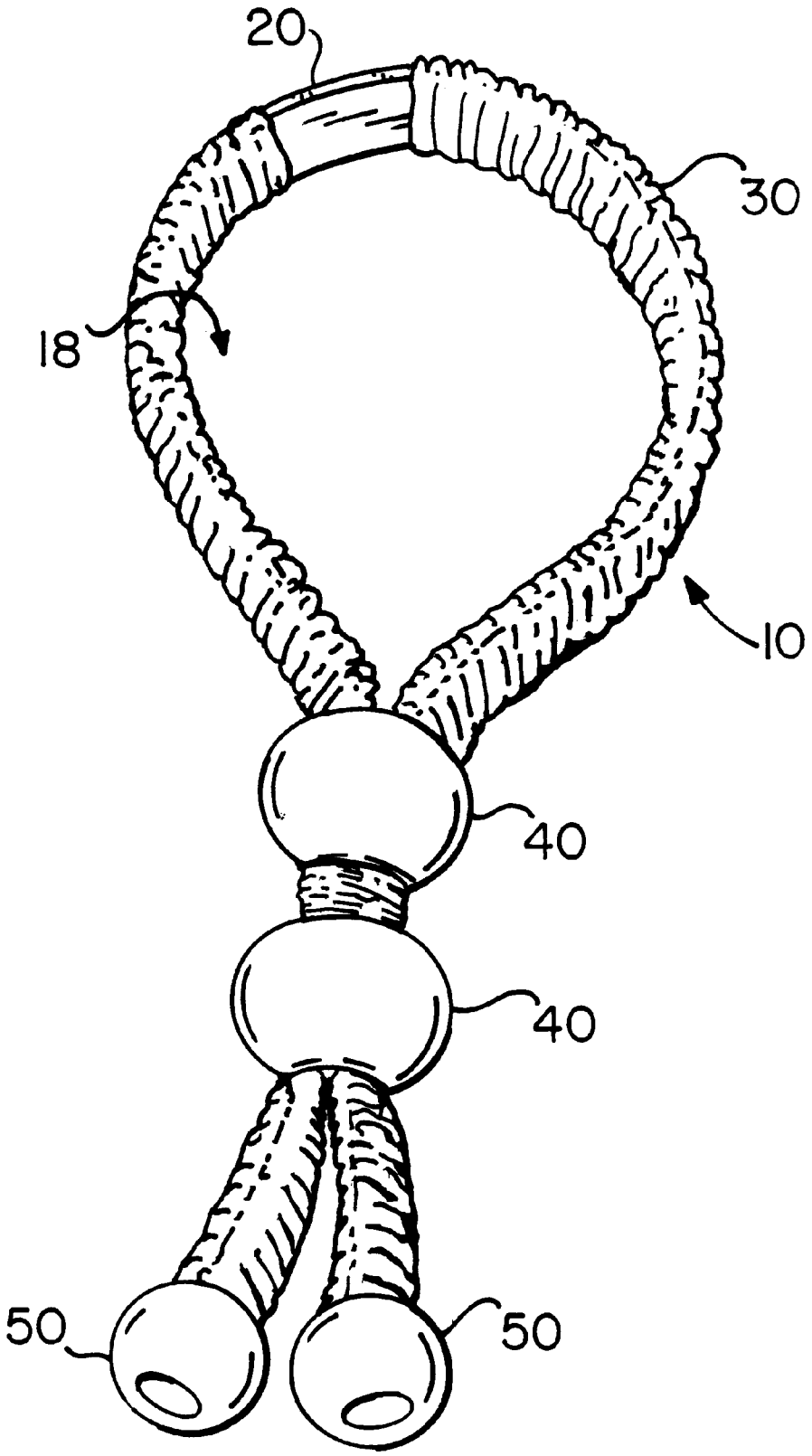
FIG. 1 is a front side elevational view illustrating the presently preferred embodiment of the looped hair fastener of the invention.

FIG. 1 illustrates a looped hair fastener 10 having a predetermined length of a long narrow elasticized member 20, having a thin, substantially rectangular cross-sectional configuration, similar in shape to a ribbon or material strip covered with fabric 30, passing through one or more stop bodies 40, forming a loop 18 generally in the middle of the cord 20, the elasticized member having terminal ends which may be tied or fitted with additional stop bodies 50. The elasticized member 20 is covered with fabric 30 which may be made from an assortment of cloth materials decorated in a variety of patterns and designs. The fabric 30 exceeds the length of the elasticized member 20 and is closed around the terminal ends of the elasticized member 20. The elasticized member 20 and the cover of fabric 30 are joined at the terminal ends. The loop 18 is formed and regulated by sliding one or more stop bodies 40 over the fabric 30 covering the elasticized member 20. Because the cover of fabric 30 exceeds the length of the elasticized member 20 the fabric 30 gathers in bunches along the looped hair fastener 10. In actual use, the bunching of fabric 30 around the open ends of the primary stop bodies 40 enables the user to more tightly fasten the looped hair tie fastener about the object to be fastened. In cases where a plurality of primary stop bodies 40 are present additional loops may be formed. The terminal ends of the looped hair tie fastener 10 may be tied or fitted with secondary stop bodies 50.

Figure 3:
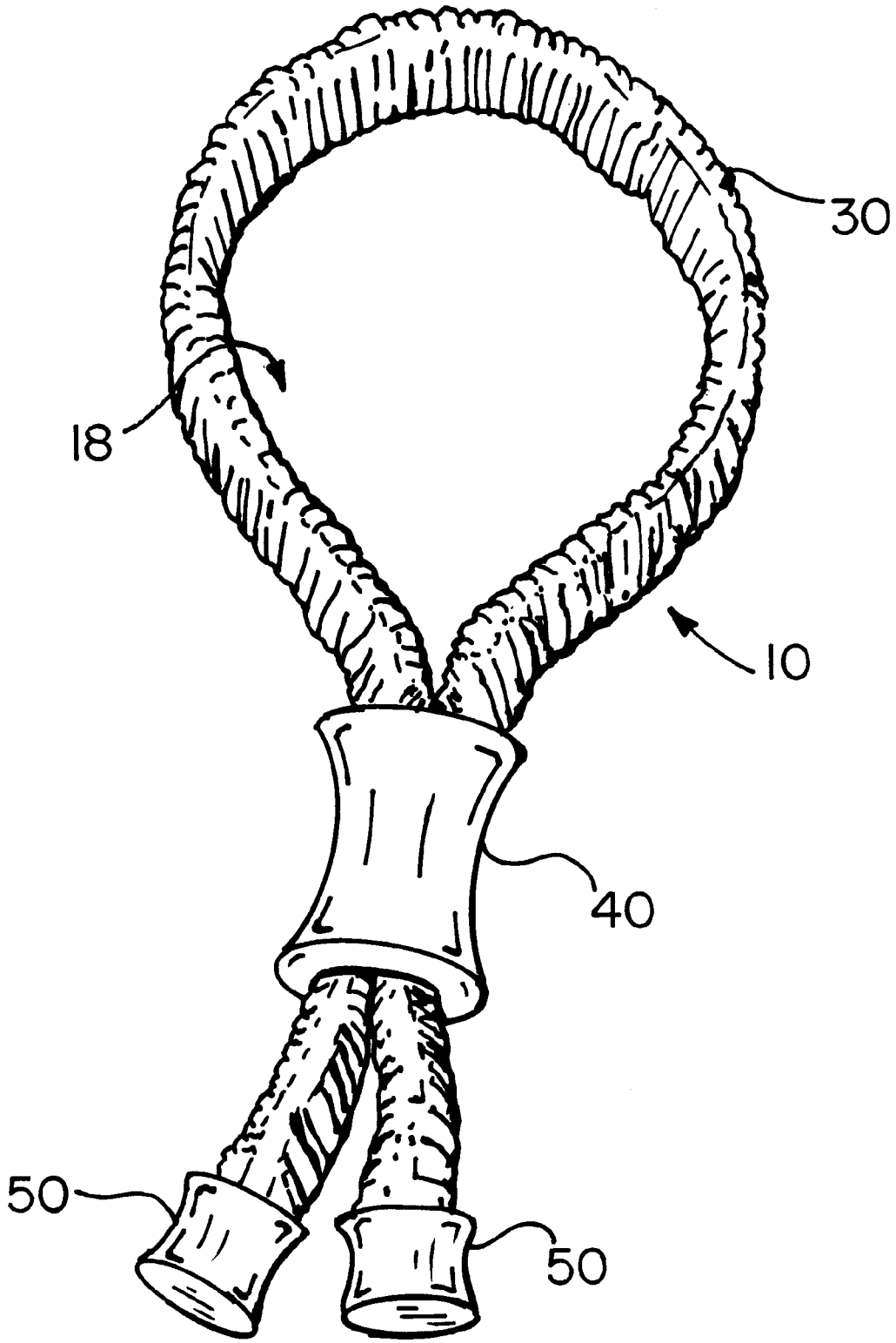
FIG. 3 is a front side elevational view thereof.

The primary stop bodies 40 and the secondary stop bodies 50 are generally spherically shaped, although a multitude of body shapes, such as cylindrical, rectangular, square, octagonal, or similar shapes could be used such as the shapes used in FIG. 3. The primary stop bodies 40 and the secondary stop bodies 50 could also be formed in the shape of characters, living things, icons, and the like. The primary stop bodies 40 and the secondary stop bodies 50 are constructed of plastic, wood, stone, gems, glass, and other suitable materials.

Figure 2:
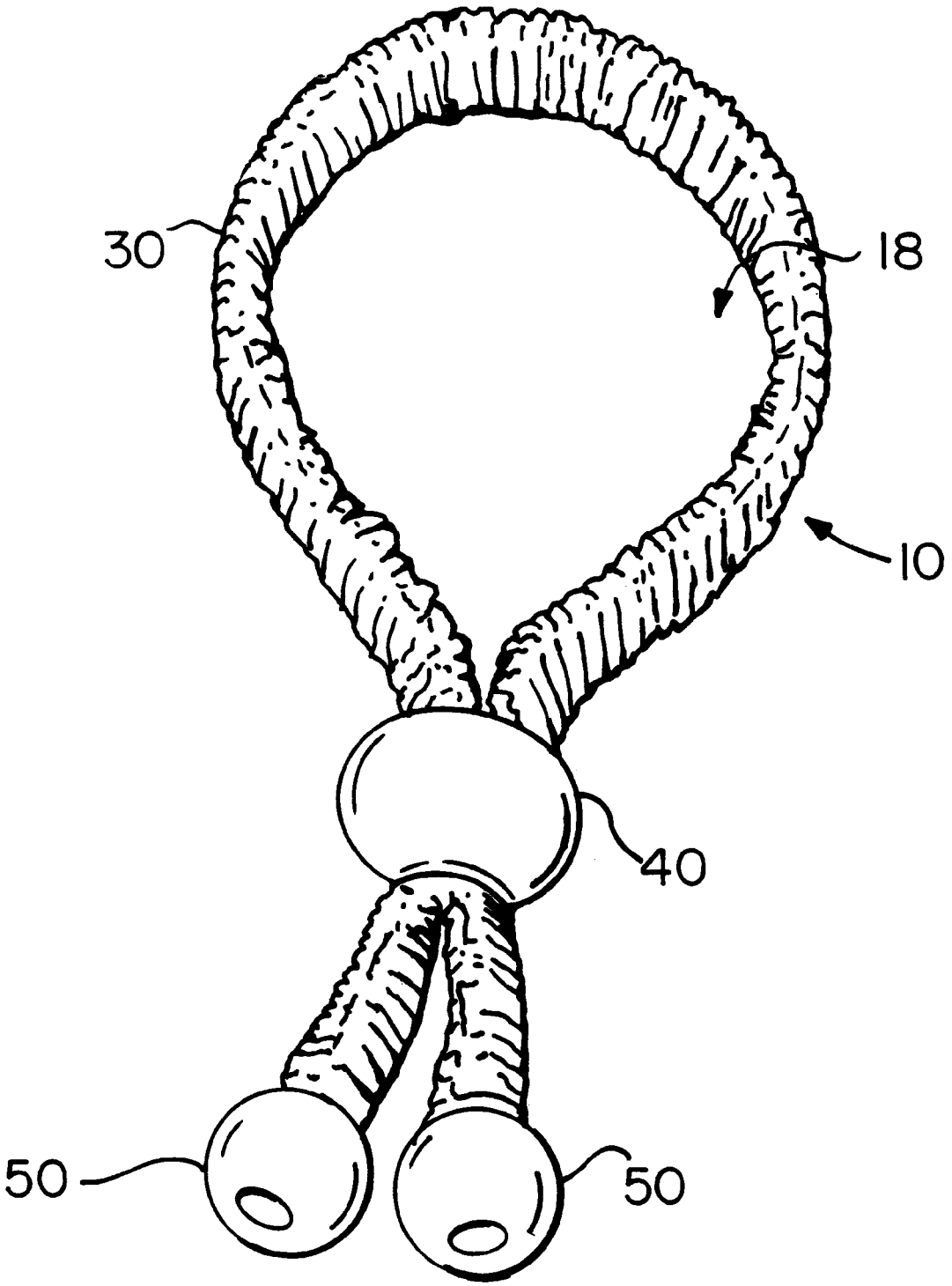
FIG. 2 is a rear elevational view thereof.

FIG. 2 illustrates the looped hair tie fastener utilizing a single primary stop body 40. In actual use conditions, the loop 18 of the looped hair tie fastener 10 is expanded to its maximum size or at least a size larger than the object to be fastened by moving the primary stop body 40 down toward the secondary stop bodies 50. Once the object to be fastened is positioned within the loop 18, the user can hold onto the primary stop body 40 and pull one or both of the secondary stop bodies 50 therefore tightening the loop around the object to be fastened. The same tightening effect may be accomplished by holding onto one or more of the secondary stop bodies 50 and sliding the primary stop body 40 toward the object to be fastened.

What is claimed is:

1. A looped fastener apparatus, comprising:

a predetermined length of a long, narrow, elasticized member having a thin, substantially rectangular cross-sectional configuration and a pair of terminal ends;

a predetermined length of fabric encompassing said elasticized member, said length of said fabric being greater than said length of said elasticized member;

a primary stop body having open ends with a hollow middle, said primary stop body removably attached to said fabric covered elasticized member by passing said terminal ends of said fabric covered elasticized member through the open ends of said primary stop body, thereby forming a loop, whereby said fabric gathers in bunches adjacent said primary stop body to better secure said primary stop body relative to said elasticized member when said loop is tightened.

2. The apparatus as defined in claim 1 and further including more than one said primary stop body.

3. The apparatus of claim 1, further comprising a pair of secondary stop bodies affixed to said terminal ends of said fabric covered elasticized member.

4. A looped fastener apparatus, comprising:

an elasticized member enclosed within a fabric and having a pair of terminal ends;

a first primary stop body having open ends with a hollow middle, said first primary stop body removably attached to said fabric covered elasticized member by passing said terminal ends of said fabric covered elasticized member through the open ends of said first primary stop body, thereby forming a first loop; and a second primary stop body having open ends with a hollow middle, said second primary stop body removably attached to said fabric covered elasticized member by passing said terminal ends of said fabric covered elasticized member through the open ends of said second primary stop body, thereby forming a second loop between said first and second primary stop bodies.

5. The apparatus of claim 1, further comprising a pair of secondary stop bodies affixed to said terminal ends of said fabric covered elasticized member.

6. The apparatus of claim 4, said elasticized member having a thin, substantially rectangular cross-sectional configuration.

7. The apparatus of claim 6, wherein the length of said fabric is greater than the length of said elasticized member, whereby said fabric gathers in bunches adjacent said first and said second primary stop bodies to better secure said first and said second primary stop bodies relative to said elasticized member when said first and second loops are tightened.

8. A looped fastener apparatus, comprising:

a long, narrow, elasticized member having a thin, substantially rectangular cross-sectional configuration and a pair of terminal ends;

fabric encompassing said elasticized member, said fabric being longer than said elasticized member whereby said fabric gathers in bunches on said elasticized member;

a primary stop body having open ends with a hollow middle, said primary stop body removably attached to said fabric covered elasticized member by passing said terminal ends of said fabric covered elasticized member through the open ends of said primary stop body, thereby forming a loop.

9. The apparatus of claim 8, further comprising a pair of secondary stop bodies affixed to said terminal ends of said elasticized member.

10. The apparatus of claim 8, further comprising a second primary stop body removably attached to said fabric covered elasticized member by passing said terminal ends of said fabric covered elasticized member through the open ends of said second primary stop body, thereby forming a second loop.

* * * * *